US008641031B2

(12) United States Patent
Nishioka et al.

(10) Patent No.: US 8,641,031 B2
(45) Date of Patent: Feb. 4, 2014

(54) SHEET FEEDER AND IMAGE FORMING APPARATUS INCLUDING SAME

(71) Applicants: Kunihiko Nishioka, Osaka (JP); Tatsuo Fukushima, Osaka (JP); Mizuna Tanaka, Osaka (JP)

(72) Inventors: Kunihiko Nishioka, Osaka (JP); Tatsuo Fukushima, Osaka (JP); Mizuna Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/749,899

(22) Filed: Jan. 25, 2013

(65) Prior Publication Data

US 2013/0207335 A1 Aug. 15, 2013

(30) Foreign Application Priority Data

Feb. 13, 2012 (JP) ..... 2012-028813

(51) Int. Cl.
*B65H 3/44* (2006.01)
*B65H 5/26* (2006.01)

(52) U.S. Cl.
USPC ..... 271/9.01; 271/9.11; 271/10.04

(58) Field of Classification Search
USPC ..... 271/9.01, 9.11, 9.13, 4.04, 10.4, 10.04
See application file for complete search history.

(56) References Cited

U.S. PATENT DOCUMENTS

| | | | | | |
|---|---|---|---|---|---|
| 4,958,822 | A * | 9/1990 | Rutishauser et al. | ..... | 271/9.11 |
| 4,966,356 | A * | 10/1990 | Ohyabu et al. | ..... | 271/9.11 |
| 2003/0025263 | A1* | 2/2003 | Koga | ..... | 271/9.12 |
| 2011/0280626 | A1 | 11/2011 | Fukushima et al. | | |
| 2012/0235345 | A1* | 9/2012 | Shiota | ..... | 271/9.11 |

FOREIGN PATENT DOCUMENTS

| | | | |
|---|---|---|---|
| JP | 05032326 | A * | 2/1993 |
| JP | 05069965 | A * | 3/1993 |
| JP | 2001-002282 | | 1/2001 |
| JP | 2001-240264 | | 9/2001 |
| JP | 2005-145674 | | 6/2005 |
| JP | 2006-151563 | | 6/2006 |
| JP | 2008-265914 | | 11/2008 |
| JP | 2009-234697 | | 10/2009 |
| JP | 2012-180142 | | 9/2012 |

* cited by examiner

*Primary Examiner* — David H Bollinger
(74) *Attorney, Agent, or Firm* — Harness, Dickey & Pierce P.L.C.

(57) ABSTRACT

A sheet feeder stackable in multiple levels and attachable to an image forming apparatus. The sheet feeder includes a drive source, a drive transmission unit, a first drive coupling unit, a second drive coupling unit, a sheet feed roller, and a grip roller. During operation of multiple sheet feeders stacked in the multiple levels, the drive transmission unit and the first drive coupling unit, both provided to a given sheet feeder of the multiple sheet feeders, are coupled to each other, and the first drive coupling unit of the given sheet feeder is coupled to the grip roller of an adjacent sheet feeder disposed immediately below the given sheet feeder to drive the grip roller of each of the multiple sheet feeders substantially in synchrony.

9 Claims, 4 Drawing Sheets

SHEET FEEDER AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-028813, filed on Feb. 13, 2012, in the Japan Patent Office, the entire disclosure of which is hereby incorporated by reference herein.

BACKGROUND OF THE INVENTION

1. Field of the Invention

Exemplary aspects of the present invention generally relate to an image forming apparatus, and more particularly to a sheet feeder in which a drive source is installed and an image forming apparatus including the sheet feeder.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

These image forming apparatuses often include multiple sheet feeders disposed one above the other at the bottom of the image forming apparatus. In a case in which a drive source is provided to each of the multiple sheet feeders, drive sources for all the multiple sheet feeders need to be driven when a recording medium is fed from a bottommost sheet feeder disposed at the bottom of the multiple sheet feeders, generating large noise.

Because a low-end type image forming apparatus tends to be installed near a user, there is an increasing demand for reducing noise generated by the drive sources, and various techniques for solving such a problem have been proposed. However, in the related-art techniques, reduction of noise generated by the drive sources becomes more difficult as the number of drives sources respectively provided for the multiple sheet feeders increases.

Specifically, in the related art, grip rollers are driven by the drive sources provided for the multiple sheet feeders via multiple clutches, respectively. Consequently, in a case in which a recording medium is fed from the bottommost sheet feeder, all the drive sources and the clutches must be driven to drive the grip rollers.

To reduce the size and the production cost of the image forming apparatus, a configuration in which both a clutch and an idler gear are provided to a shaft of a sheet feed roller to transmit a drive force from a motor to the sheet feed roller via the clutch and to a manual sheet feed roller via the idler gear is possible. In other words, the single drive source and clutch are used for driving the two separate rollers. However, in a case in which the image forming apparatus includes multiple sheet feeders disposed one above the other, multiple drive sources are still necessary for the multiple sheet feeders, respectively, and thus the problem of the noise generated by the multiple drive sources still remains unsolved.

SUMMARY OF THE INVENTION

In view of the foregoing, embodiments of the present invention provide a novel sheet feeder including a drive source. In a case in which multiple sheet feeders, each having a drive source, are stacked in multiple levels, only a drive source provided for a given sheet feeder, from which a recording medium is fed, is driven during feeding of the recording medium to reduce noise generated by the drive source.

Illustrative embodiments of the present invention also provide a novel image forming apparatus including the sheet feeder.

In one illustrative embodiment, a sheet feeder stackable in multiple levels and attachable to an image forming apparatus includes a drive source, a drive transmission unit, a first drive coupling unit connected to the drive source via the drive transmission unit, a second drive coupling unit connected to the drive source via the drive transmission unit and the first drive coupling unit, a sheet feed roller coaxial with the second drive coupling unit to feed a recording medium from the sheet feeder, and a grip roller provided downstream from the sheet feed roller in a sheet feeding direction. The sheet feed roller is driven by a drive force of the drive source transmitted to the second drive coupling unit via the drive transmission unit and the first drive coupling unit. The grip roller is driven by a drive force of the drive source transmitted to the first drive coupling unit via the drive transmission unit. During operation of multiple sheet feeders stacked in the multiple levels, the drive transmission unit and the first drive coupling unit, both provided to a given sheet feeder of the multiple sheet feeders, are coupled to each other, and the first drive coupling unit of the given sheet feeder is coupled to the grip roller of an adjacent sheet feeder disposed immediately below the given sheet feeder to drive the grip roller of each of the multiple sheet feeders substantially in synchrony.

In another illustrative embodiment, an image forming apparatus includes an image forming unit to form an image on a recording medium and the sheet feeder described above to feed the recording medium to the image forming unit.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
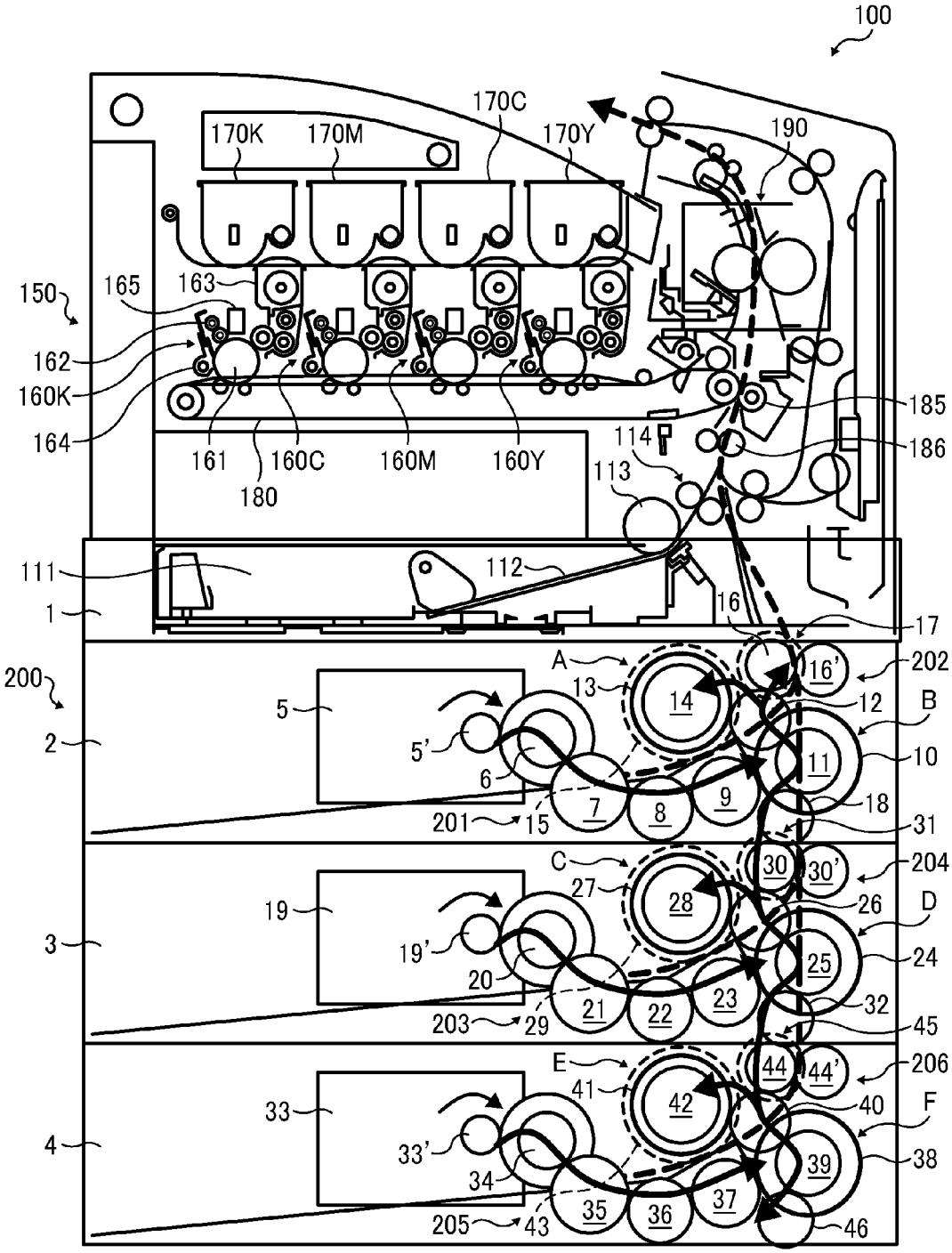
FIG. 1 is a vertical cross-sectional view illustrating an example of a configuration of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of an image forming apparatus 100 according to a first illustrative embodiment are described in detail below, with reference to FIG. 1.

FIG. 1 is a vertical cross-sectional view illustrating an example of a configuration of the image forming apparatus 100 according to the first illustrative embodiment. The image forming apparatus 100 includes an image forming unit 150 at the top thereof, a first sheet feed unit, which, in the present illustrative embodiment, is a sheet tray 1 disposed below the image forming unit 150, and a second sheet feed unit 200 additionally provided to the image forming apparatus 100 below the first sheet feed unit. The second sheet feed unit 200 includes multiple sheet feeders, which, in the present illustrative embodiments, are sheet trays 2, 3, and 4 disposed, in that order, from the top to the bottom below the sheet tray 1. It is to be noted that each bold solid arrow in FIG. 1 and subsequent drawings indicates a drive train, and each bold broken line indicates a conveyance path of a recording medium such as a sheet of paper.

The image forming unit 150 includes photoconductor units 160Y, 160M, 160C, and 160K (hereinafter collectively referred to as photoconductor units 160) that form a toner image of a specific color, that is, yellow (Y), magenta (M), cyan (C), or black (K).

Figure 3:
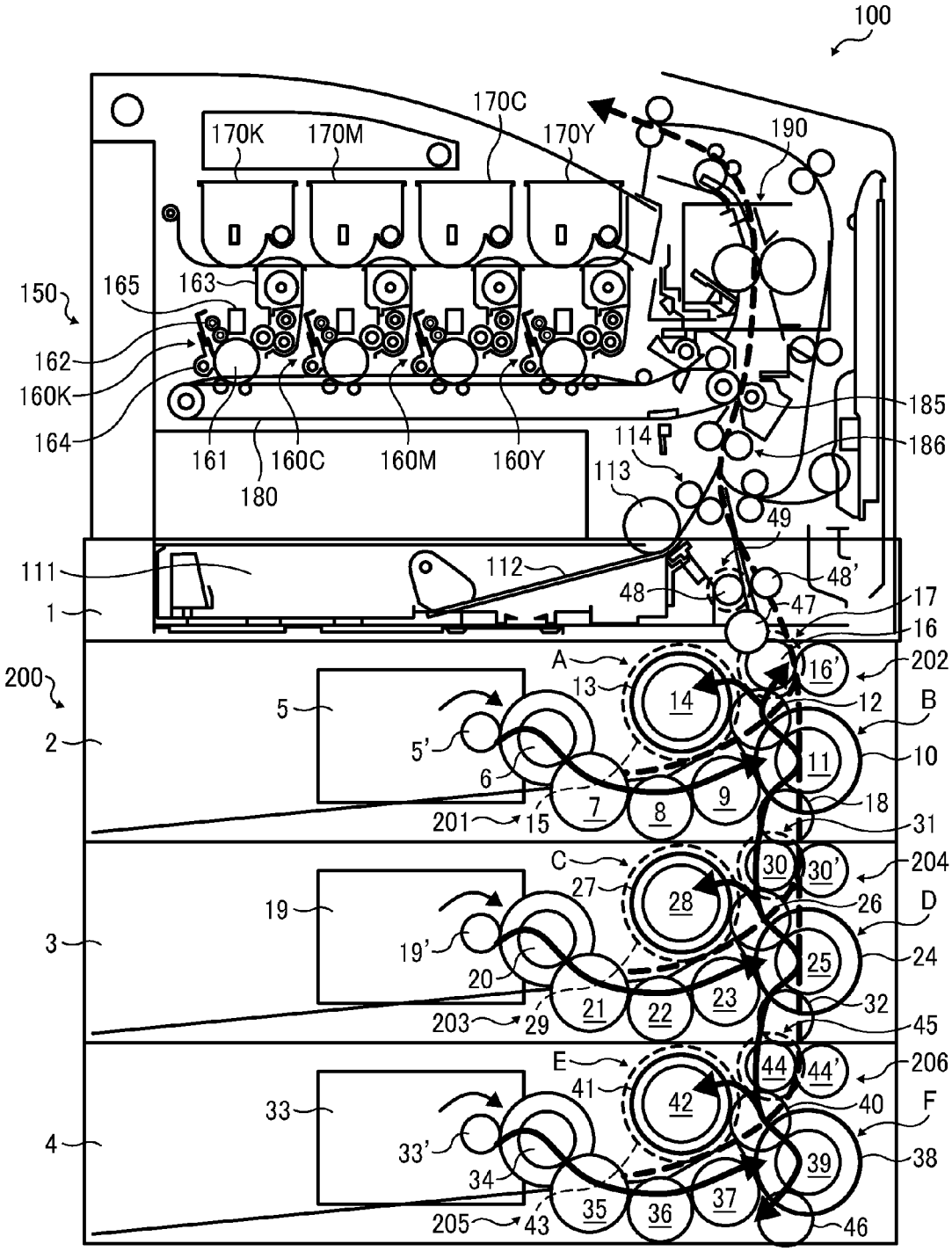
FIG. 3 is a vertical cross-sectional view illustrating an example of a configuration of an image forming apparatus according to a second illustrative embodiment.

Each of the photoconductor units 160 has the same basic configuration, differing only in the color of toner used. Therefore, suffixes Y, M, C, and K, each representing the color of toner, are hereinafter omitted unless otherwise necessary. It is to be noted that only the reference numerals each denoting a component of the photoconductor unit 160K are shown in FIGS. 1 and 3. Each of the photoconductor units 160 includes an image carrier, which, in the present illustrative embodiment, is a drum-type photoconductor 161, a charger 162 that charges the photoconductor 161, a developing device 163 that develops an electrostatic latent image formed on the photoconductor 161 with toner, and a cleaning device 164 that removes residual toner from the photoconductor 161. The photoconductor 161, the charger 162, the developing device 163, and the cleaning device 164 of each of the photoconductor units 160 are formed together as a single integrated process cartridge detachably attachable to the image forming unit 150. A light-emitting element 165 that irradiates the photoconductor 161 with light to form the electrostatic latent image on the photoconductor 161 is disposed above each of the respective photoconductor units 160.

An intermediate transfer belt 180 onto which a toner image formed by each of the photoconductor units 160 is primarily transferred is disposed below the photoconductor units 160. The intermediate transfer belt 180 is wound around multiple rollers, and toner images of the specified colors respectively formed on the photoconductors 161 of the photoconductor units 160 are sequentially transferred onto the intermediate transfer belt 180 one atop the other to form a single full-color toner image on the intermediate transfer belt 180.

A belt cleaning device, not shown, that removes residual untransferred toner from the intermediate transfer belt 180 is disposed around the intermediate transfer belt 180. The image forming unit 150 further includes a secondary transfer roller 185 that secondarily transfer the full-color toner image formed on the intermediate transfer belt 180 onto a recording medium, and a fixing unit 190 that fixes the toner image on the recording medium. Toner cartridges 170Y, 170C, 170M, and 170K (hereinafter collectively referred to as toner cartridges 170) that supply toner to the respective developing devices 163 are disposed above the photoconductor units 160.

Full-color image formation performed by the image forming apparatus 100 is described in detail below. In each of the photoconductor units 160, the charger 162 evenly charges the photoconductor 161. Next, the light-emitting element 165 irradiates the photoconductor 161 with light based on image data to form an electrostatic latent image on the photoconductor 161.

The electrostatic latent image formed on the photoconductor 161 is then developed with toner of the specified color borne by a developing roller included in the developing device 163 so that a toner image is formed on the photoconductor 161. The above-described sequence of toner image formation is performed in each of the photoconductor units 160. Toner images formed on each of the photoconductors 161 are sequentially transferred one atop the other onto the intermediate transfer belt 180 rotated in a clockwise direction in FIG. 1 so that a single full-color toner image is formed on the intermediate transfer belt 180.

After primary transfer of the toner images from the photoconductors 161 onto the intermediate transfer belt 180, the cleaning device 164 cleans the photoconductor 161 to be ready for the next sequence of image formation on the photoconductor 161. In the mean time, a recording medium such as a sheet of paper is conveyed by a pair of registration rollers 186 at a predetermined timing to a secondary transfer area formed between the intermediate transfer belt 180 and the secondary transfer roller 185. At the secondary transfer area in which the secondary transfer roller 185 and the intermediate transfer belt 180 contact each other, the full-color toner image formed on the intermediate transfer belt 180 is secondarily transferred onto the recording medium. The recording medium having the full-color toner image thereon is then conveyed to the fixing unit 190 so that the toner image is fixed onto the recording medium by the fixing unit 190. Thereafter, the recording medium having the fixed image thereon is discharged from the image forming apparatus 100. After secondary transfer of the toner image from the intermediate transfer belt 180 onto the recording medium, the belt cleaning device that contacts the intermediate transfer belt 180 removes untransferred toner remaining on the intermediate transfer belt 180.

The sheet tray 1 disposed immediately below the image forming unit 150 includes a recording medium container 111 that accommodates a stack of recording media, a bottom plate 112 on which the stack of recording media is placed, a pickup roller 113 that picks up a sheet of recording medium placed at the top of the stack of recording media on the bottom plate 112, and a pair of conveyance rollers 114 that conveys the recording medium thus picked up by the pickup roller 113. The bottom plate 112 is provided to the recording medium container 111. One end of the bottom plate 112 is hinged about a shaft, and the bottom plate 112 is pressed upward. A drive source such as a motor, not shown, that drives the pickup roller 113 and the pair of conveyance rollers 114 is provided to the sheet tray 1 individually from drive sources for the second sheet feed unit 200.

As described previously, the second sheet feed unit 200 is additionally provided to the image forming apparatus 1 below the sheet tray 1. The second sheet feed unit 200 includes the sheet trays 2 to 4. The topmost sheet tray 2 of the second sheet feed unit 200 is disposed below the sheet tray 1, the sheet tray 3 is disposed below the sheet tray 2, and the sheet tray 4 is disposed below the sheet tray 3 at the bottom of the second sheet feed unit 200. Each of the sheet trays 1 to 4 can accommodate a stack of recording media of predetermined type and size.

Figure 2:
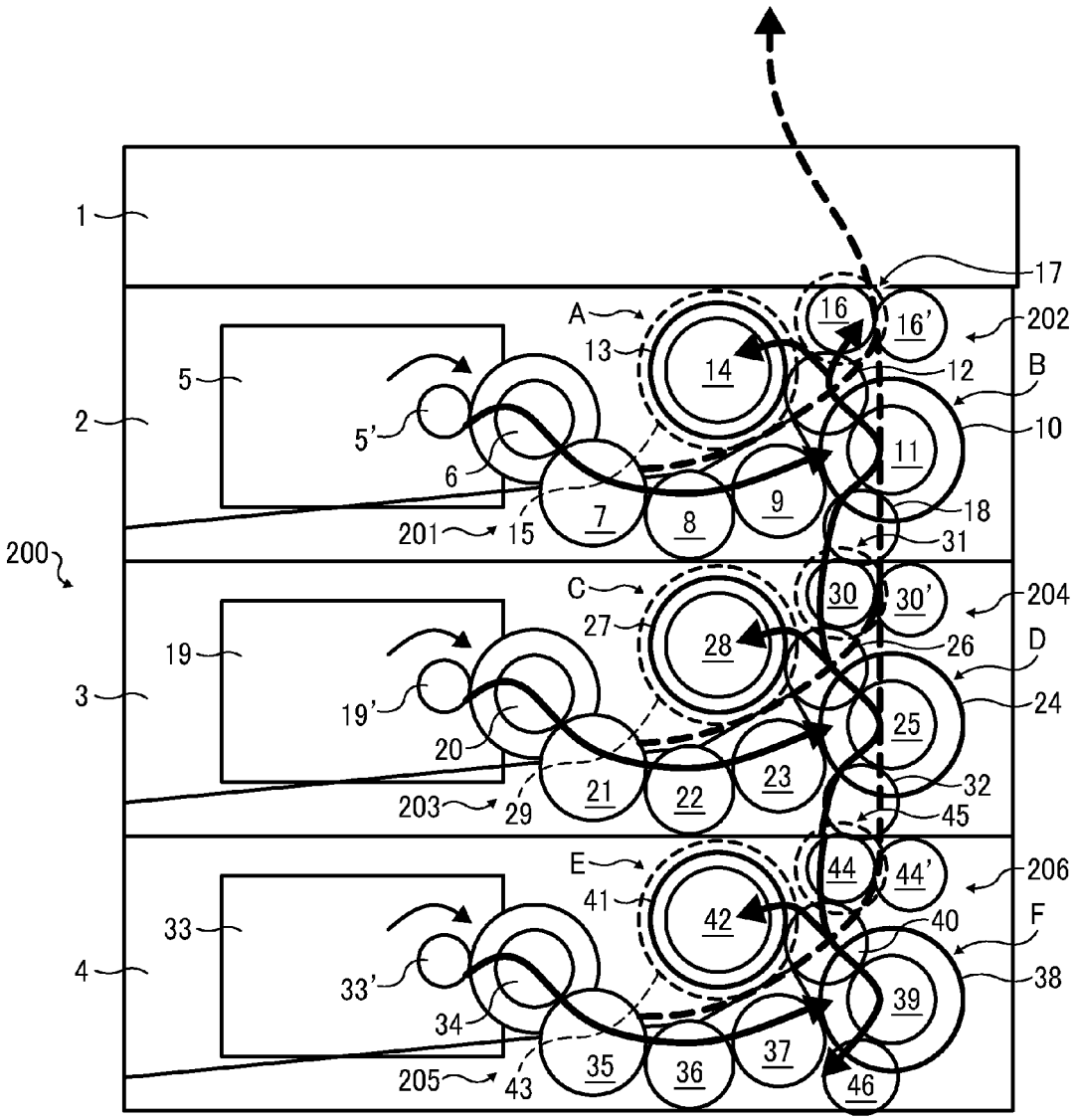
FIG. 2 is a vertical cross-sectional view illustrating an example of a configuration of a second sheet feed unit included in the image forming apparatus illustrated in FIG. 1.

FIG. 2 is a vertical cross-sectional view illustrating an example of a configuration of the second sheet feed unit 200 according to the first illustrative embodiment.

The topmost sheet tray 2 of the second sheet feed unit 200 includes a drive source 5, an electromagnetic clutch B, and a drive transmission unit 201 that transmits a drive force from an output gear 5' of the drive source 5 to an input gear 10 of the electromagnetic clutch B via a reduction gear 6 and idler gears 7, 8, and 9. Grip rollers 16 and 16', each of which conveys a recording medium to the image forming unit 150, are provided opposite each other in the sheet tray 2, and a grip roller drive gear 17 is provided coaxially with the grip roller 16. The sheet tray 2 also includes idler gears 12 and 18, both of which are coupled to an output gear 11 of the electromagnetic clutch B. In the present illustrative embodiment, the electromagnetic clutch B, the idler gear 12, the grip roller drive gear 17, and the idler gear 18 together form a first drive coupling unit 202 of the sheet tray 2. The sheet tray 2 further includes a second drive coupling unit, which, in the present illustrative embodiment, is an electromagnetic clutch A. An input gear 13 of the electromagnetic clutch A is coupled to the idler gear 12. The idler gear 18 is also coupled to a grip roller drive gear 31 coaxially provided with a grip roller 30 included in the sheet tray 3 described below.

The sheet tray 3 includes a drive source 19, an electromagnetic clutch D, and a drive transmission unit 203 that transmits a drive force from an output gear 19' of the drive source 19 to an input gear 24 of the electromagnetic clutch D via a reduction gear 20 and idler gears 21, 22, and 23. Grip rollers 30 and 30', each of which conveys a recording medium to the image forming unit 150, are provided opposite each other in the sheet tray 3, and the grip roller drive gear 31 is coaxially provided with the grip roller 30. The sheet tray 3 also includes idler gears 26 and 32, both of which are coupled to an output gear 25 of the electromagnetic clutch D. In the present illustrative embodiment, the electromagnetic clutch D, the idler gear 26, the grip roller drive gear 31, and the idler gear 32 together form a first drive coupling unit 204 of the sheet tray 3. The sheet tray 3 further includes a second drive coupling unit, which, in the present illustrative embodiment, is an electromagnetic clutch C. An input gear 27 of the electromagnetic clutch C is coupled to the idler gear 26. The idler gear 32 is also coupled to a grip roller drive gear 45 coaxially provided with a grip roller 44 included in the sheet tray 4 described below.

The sheet tray 4 includes a drive source 33, an electromagnetic clutch F, and a drive transmission unit 205 that transmits a drive force from an output gear 33' of the drive source 33 to an input gear 38 of the electromagnetic clutch F via a reduction gear 34 and idler gears 35, 36, and 37. Grip rollers 44 and 44', each of which conveys a recording medium to the image forming unit 150, are provided opposite each other in the sheet tray 4, and the grip roller drive gear 45 is coaxially provided with the grip roller 44. The sheet tray 4 also includes idler gears 40 and 46, both of which are coupled to an output gear 39 of the electromagnetic clutch F. In the present illustrative embodiment, the electromagnetic clutch F, the idler gear 40, the grip roller drive gear 45, and the idler gear 46 together form a first drive coupling unit 206 of the sheet tray 4. The sheet tray 4 further includes a second drive coupling unit, which, in the present illustrative embodiment, is an electromagnetic clutch E. An input gear 41 of the electromagnetic clutch E is coupled to the idler gear 40.

A method for driving the sheet tray 2, 3, or 4 to feed the recording medium to the image forming unit 150 is described in detail below with reference to FIGS. 1 and 2. It should be noted that the speed of the drive sources 5, 19, and 33 need not be fixed and may instead be variable, and moreover the drive sources 5, 19, and 33 may operate in reverse as well as forward.

In a case of feeding a recording medium from the sheet tray 2, the drive source 5 is driven and thus the output gear 5' of the drive source 5 is rotated in a clockwise direction in FIGS. 1 and 2. The drive force of the drive source 5 is transmitted from the output gear 5' to the input gear 10 of the electromagnetic clutch B via the reduction gear 6 and the idler gears 7, 8, and 9 and is further transmitted to the input gear 13 of the electromagnetic clutch A via the idler gear 12, so that both the electromagnetic clutches A and B are engaged. Accordingly, the input gear 10 and the output gear 11 of the electromagnetic clutch B are coupled to each other and the input gear 13 and an output gear 14 of the electromagnetic clutch A are coupled to each other. As a result, a sheet feed roller 15 coaxially provided with the output gear 14 of the electromagnetic clutch A is rotated in a counterclockwise direction in FIGS. 1 and 2 to feed a recording medium from the sheet tray 2. The drive force is further transmitted to the grip roller drive gear 17 via the idler gear 12 coupled to the output gear 11 of the electromagnetic clutch B so that the grip roller 16 is rotated in the counterclockwise direction to convey the recording medium to the image forming unit 150. While the electromagnetic clutch B is engaged, the drive force is also transmitted to the grip roller drive gear 31 of the sheet tray 3 disposed below the sheet tray 2 and the grip roller drive gear 45 of the bottommost sheet tray 4 disposed below the sheet tray 3 via the first drive coupling units 202, 204, and 206 coupled to one another. Therefore, all the grip rollers 16, 30, and 44 of the sheet trays 2, 3, and 4 are rotated while the electromagnetic clutch B is engaged. However, because the electromagnetic clutches D and F of the sheet trays 3 and 4 are disengaged, the output gears 25 and 39 of the electromagnetic clutches D and F are idly rotated and no drive force is transmitted to the input gears 24 and 38 of the electromagnetic clutches D and F, respectively. As a result, no drive force is transmitted to the output gears 19' and 33' of the drive sources 19 and 33 of the sheet trays 3 and 4. When the electromagnetic clutch B is disengaged, rotation of each of the grip rollers 16, 30, and 44 is stopped.

In a case of feeding a recording medium from the sheet tray 3, the drive source 19 is driven and thus the output gear 19' of the drive source 19 is rotated in a clockwise direction in FIGS. 1 and 2. The drive force of the drive source 19 is transmitted from the output gear 19' to the input gear 24 of the electromagnetic clutch D and is further transmitted to the input gear 27 of the electromagnetic clutch C so that both the electromagnetic clutches D and C are engaged. Accordingly, the input gear 24 and the output gear 25 of the electromagnetic clutch D are coupled to each other and the input gear 27 and an output gear 28 of the electromagnetic clutch C are coupled to each other. As a result, a sheet feed roller 29 coaxially provided with the output gear 28 of the electromagnetic clutch C is rotated in a counterclockwise direction in FIGS. 1 and 2 to feed a recording medium from the sheet tray 3. The drive force is further transmitted to the grip roller drive gear 31 via the idler gear 26 coupled to the output gear 25 of the electromagnetic clutch D so that the grip roller 30 is rotated in the counterclockwise direction to convey the recording medium to the image forming unit 150. While the electromagnetic clutch D is engaged, the drive force is also transmitted to the grip roller drive gear 45 of the bottommost sheet tray 4 disposed below the sheet tray 3 and the grip roller drive gear 17 of the topmost sheet tray 2 disposed above the sheet tray 3 via the first drive coupling units 202, 204, and 206 coupled to one another. Therefore, all the grip rollers 16, 30, and 44 of the sheet trays 2, 3, and 4 are rotated while the electromagnetic clutch D is engaged. However, because the electromagnetic clutches B and F of the sheet trays 2 and 4 are disengaged, the output gears 11 and 39 of the electromagnetic clutches B and F are idly rotated and no drive force is transmitted to the input gears 10 and 38 of the electromagnetic clutches B and F. As a result, no drive force is transmitted to the output gears 5' and 33' of the drive sources 5 and 33 of the sheet trays 2 and 4. When the electromagnetic clutch D is disengaged, rotation of each of the grip rollers 16, 30, and 44 is stopped.

In a case of feeding a recording medium from the sheet tray 4, the drive source 33 is driven and thus the output gear 33' of the drive source 33 is rotated in a clockwise direction in FIGS. 1 and 2. The drive force of the drive source 33 is transmitted from the output gear 33' to the input gear 38 of the electromagnetic clutch F and is further transmitted to the input gear 41 of the electromagnetic clutch E so that both the electromagnetic clutches F and E are engaged. Accordingly, the input gear 38 and the output gear 39 of the electromagnetic clutch F are coupled to each other and the input gear 41 and an output gear 42 of the electromagnetic clutch E are coupled to each other. As a result, a sheet feed roller 43 coaxially provided to the output gear 42 of the electromagnetic clutch E is rotated in a counterclockwise direction in FIGS. 1 and 2 to feed a recording medium from the sheet tray 4. The drive force is further transmitted to the grip roller drive gear 45 via the idler gear 40 coupled to the output gear 39 of the electromagnetic clutch F so that the grip roller 44 is rotated in the counterclockwise direction to convey the recording medium to the image forming unit 150. While the electromagnetic clutch F is engaged, the drive force is also transmitted to the grip roller drive gear 31 of the sheet tray 3 disposed above the sheet tray 4 and the grip roller drive gear 17 of the topmost sheet tray 2 disposed above the sheet tray 3 via the first drive coupling units 202, 204, and 206 coupled to one another. Therefore, all the grip rollers 16, 30, and 44 of the sheet trays 2, 3, and 4 are rotated while the electromagnetic clutch F is engaged. However, because the electromagnetic clutches B and D are disengaged, the output gears 11 and 25 of the electromagnetic clutches B and D are idly rotated and no drive force is transmitted to the input gears 10 and 24 of the electromagnetic clutches B and D. As a result, no drive force is transmitted to the output gears 5' and 19' of the drive sources 5 and 19 of the sheet trays 2 and 3. When the electromagnetic clutch F is disengaged, rotation of each of the grip rollers 16, 30, and 44 is stopped.

A description is now given of a second illustrative embodiment of the present invention.

Figure 4:
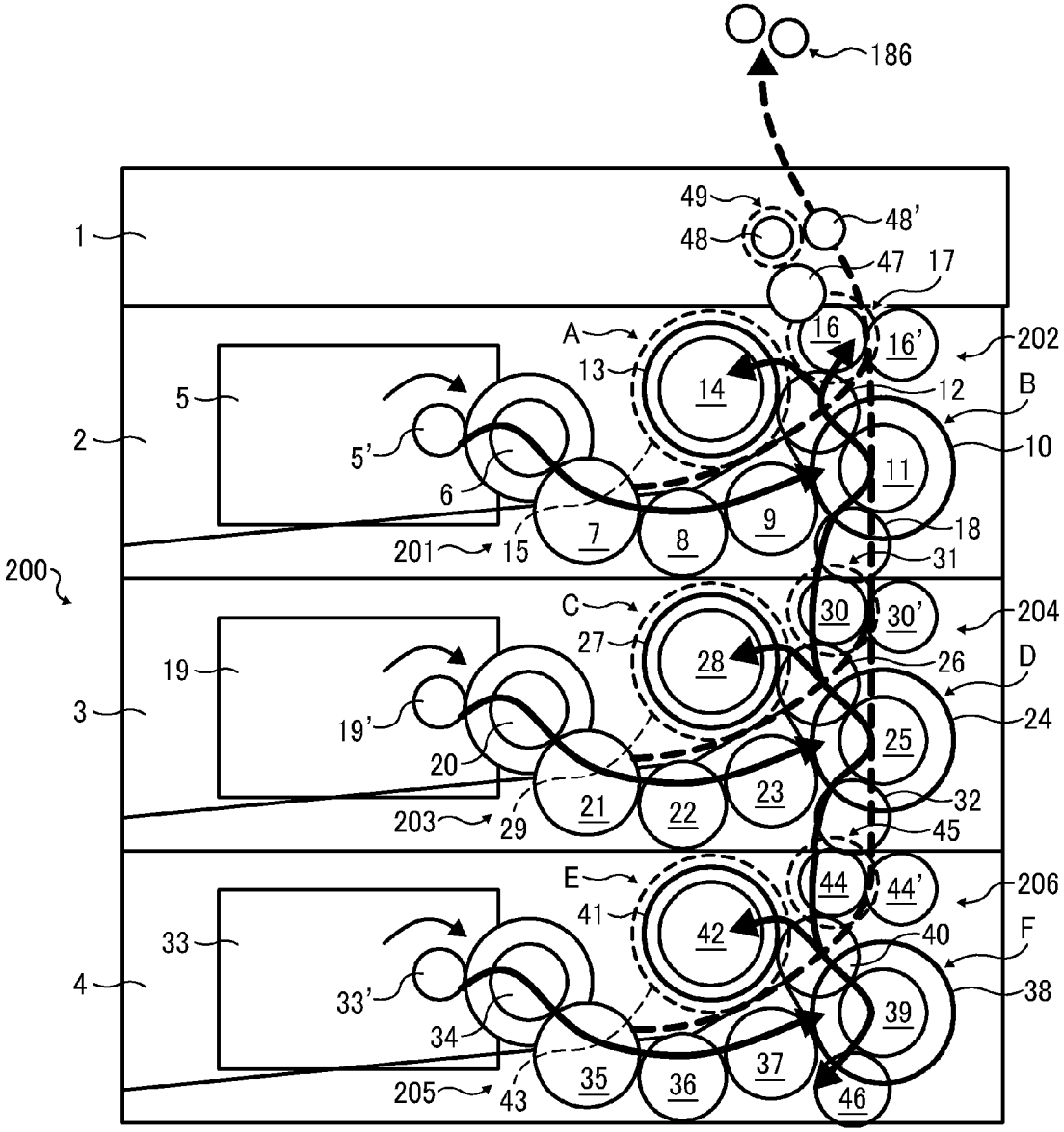
FIG. 4 is a vertical cross-sectional view illustrating an example of a configuration of a second sheet feed unit included in the image forming apparatus illustrated in FIG. 3.

FIG. 3 is vertical cross-sectional view illustrating an example of a configuration of the image forming apparatus 100 according to the second illustrative embodiment. FIG. 4 is a vertical cross-sectional view illustrating an example of a configuration of the second sheet feed unit 200 according to the second illustrative embodiment. It is to be noted that, in the second illustrative embodiment, the same reference numerals are used for the same components as those of the first illustrative embodiment, and a description of such components is omitted.

In the second illustrative embodiment, the first sheet feed unit, which in the present illustrative embodiment, is the sheet tray 1, further includes an idler gear 47, auxiliary rollers 48 and 48', and a gear 49 coaxially provided with the auxiliary roller 48.

A method for driving the sheet tray 2, 3, or 4 to feed a recording medium to the image forming unit 150 according to the second illustrative embodiment is described in detail below with reference to FIGS. 3 and 4.

In a case of feeding a recording medium from the sheet tray 2, the drive source 5 is driven and thus the output gear 5' of the drive source 5 is rotated in a clockwise direction in FIGS. 3 and 4. The drive force is transmitted from the output gear 5' to the input gear 10 of the electromagnetic clutch B and is further transmitted to the input gear 13 of the electromagnetic clutch A, so that both the electromagnetic clutches A and B are engaged. Accordingly, the input gear 10 and the output gear 11 of the electromagnetic clutch B are coupled to each other and the input gear 13 and the output gear 14 of the electromagnetic clutch A are coupled to each other. As a result, the sheet feed roller 15 coaxially provided with the output gear 14 of the electromagnetic clutch A is rotated in a counterclockwise direction in FIGS. 3 and 4 to feed a recording medium from the sheet tray 2. The drive force is further transmitted to the grip roller drive gear 17 via the idler gear 12 coupled to the output gear 11 of the electromagnetic clutch B so that the grip roller 16 is rotated in the counterclockwise direction to convey the recording medium to the image forming unit 150. At this time, the grip roller drive gear 17 is also connected to the gear 49 coaxially provided with the auxiliary roller 48 via the idler gear 47 provided to the sheet tray 1. In a case of feeding a recording medium of a size smaller than a length from the grip roller 16 of the sheet tray 2 to the pair of registration rollers 186 provided to the image forming unit 150, the auxiliary roller 48 conveys the recording medium to the pair of registration rollers 186 after a trailing edge of the recording medium has passed through the grip roller 16. While the electromagnetic clutch B is engaged, the drive force is transmitted to the grip roller drive gear 31 of the sheet tray 3 disposed below the sheet tray 2 and the grip roller drive gear 45 of the bottommost sheet tray 4 disposed below the sheet tray 3 via the first drive coupling units 202, 204, and 206 coupled to one another, thereby rotating all the grip rollers 16, 30, and 44 provided to the sheet trays 2, 3, and 4, respectively. However, because the electromagnetic clutches D and F of the sheet trays 3 and 4 are disengaged, the output gears 25 and 39 of the electromagnetic clutches D and F are idly rotated and no drive force is transmitted to the input gears 24 and 38 of the electromagnetic clutches D and F. As a result, no drive force is transmitted to the output gears 19' and 33' of the drive sources 19 and 33 of the sheet trays 3 and 4. When the electromagnetic clutch B is disengaged, rotation of each of the grip rollers 16, 30, and 44 is stopped.

In a case of feeding a recording medium from the sheet tray 3, the drive source 19 is driven and thus the output gear 19' of the drive source 19 is rotated in a clockwise direction in FIGS. 3 and 4. The drive force is transmitted from the output gear 19' to the input gear 24 of the electromagnetic clutch D and is further transmitted to the input gear 27 of the electromagnetic clutch C, so that both the electromagnetic clutches D and C are engaged. Accordingly, the input gear 24 and the output gear 25 of the electromagnetic clutch D are coupled to each other and the input gear 27 and the output gear 28 of the electromagnetic clutch C are coupled to each other. As a result, the sheet feed roller 29 coaxially provided with the output gear 28 of the electromagnetic clutch C is rotated in a counterclockwise direction in FIGS. 3 and 4 to feed a recording medium from the sheet tray 3. The drive force is further transmitted to the grip roller drive gear 31 via the idler gear 26 coupled to the output gear 25 of the electromagnetic clutch D so that the grip roller 30 is rotated in the counterclockwise direction to convey the recording medium to the image forming unit 150.

While the electromagnetic clutch D is engaged, the drive force is also transmitted to the grip roller drive gear 45 of the bottommost sheet tray 4 disposed below the sheet tray 3 and the grip roller drive gear 17 of the topmost sheet tray 2 disposed above the sheet tray 3 via the first drive coupling units 202, 204, and 206 coupled to one another, thereby rotating all the grip rollers 16, 30, and 44 of the sheet trays 2, 3, and 4, respectively. However, because the electromagnetic clutches B and F are disengaged, the output gears 11 and 39 of the electromagnetic clutches B and F are idly rotated and no drive force is transmitted to the input gears 10 and 38 of the electromagnetic clutches B and F. As a result, no drive force is transmitted to the output gears 5' and 33' of the drive sources 5 and 33 of the sheet trays 2 and 4. At this time, the grip roller drive gear 17 of the topmost sheet tray 2 is also connected to the gear 49 coaxially provided with the auxiliary roller 48 via the idler gear 47 provided to the sheet tray 1. In a case of feeding a recording medium of a size smaller than the length from the grip roller 16 of the sheet tray 2 to the pair of registration rollers 186 provided to the image forming unit 150, the auxiliary roller 48 conveys the recording medium to the pair of registration rollers 186 after the trailing edge of the recording medium has passed through the grip roller 16. When the electromagnetic clutch D is disengaged, rotation of each of the grip rollers 16, 30, and 44 is stopped.

In a case of feeding a recording medium from the bottommost sheet tray 4, the drive source 33 is driven and thus the output gear 33' of the drive source 33 is rotated in a clockwise direction in FIGS. 3 and 4. The drive force is transmitted from the output gear 33' to the input gear 38 of the electromagnetic clutch F and is further transmitted to the input gear 41 of the electromagnetic clutch E, so that both the electromagnetic clutches F and E are engaged. Accordingly, the input gear 38 and the output gear 39 of the electromagnetic clutch F are coupled to each other and the input gear 41 and the output gear 42 of the electromagnetic clutch E are coupled to each other. As a result, the sheet feed roller 43 coaxially provided with the output gear 42 of the electromagnetic clutch E is rotated in a counterclockwise direction in FIGS. 3 and 4 to feed a recording medium from the sheet tray 4. The drive force is further transmitted to the grip roller drive gear 45 via the idler gear 40 coupled to the output gear 39 of the electromagnetic clutch F so that the grip roller 44 is rotated in the counterclockwise direction to convey the recording medium to the image forming unit 150.

While the electromagnetic clutch F is engaged, the drive force is also transmitted to the grip roller drive gear 31 of the sheet tray 3 disposed above the sheet tray 4 and the grip roller drive gear 17 of the topmost sheet tray 2 disposed above the sheet tray 3 via the first drive coupling units 202, 204, and 206 coupled to one another, thereby rotating all the grip rollers 16, 30, and 44 of the sheet trays 2, 3, and 4, respectively. However, because the electromagnetic clutches B and D are disengaged, the output gears 11 and 25 of the electromagnetic clutches B and D are idly rotated and no drive force is transmitted to the input gears 10 and 24 of the electromagnetic clutches B and D. As a result, the drive force is not transmitted to the output gears 5' and 19' of the drive sources 5 and 19 of the sheet trays 2 and 3. At this time, the grip roller drive gear 17 of the sheet tray 2 is also connected to the gear 49 coaxially provided with the auxiliary roller 48 via the idler gear 47 provided to the sheet tray 1. In a case of feeding a recording medium of a size smaller than the length from the grip roller 16 of the sheet tray 2 to the pair of registration rollers 186 provided to the image forming unit 150, the auxiliary roller 48 conveys the recording medium to the pair of registration rollers 186 after the trailing edge of the recording medium has passed through the grip roller 16. When the electromagnetic clutch F is disengaged, rotation of each of the grip rollers 16, 30, and 44 is stopped.

In the foregoing illustrative embodiments, all the grip rollers 16, 30, and 44 respectively provided to the sheet trays 2, 3, and 4 are connected to one another via the output gears 11, 25, and 39 of the electromagnetic clutches B, D and F. As a result, the single drive source 5, 19, or 33 of the sheet tray 2, 3, or 4, from which the recording medium is fed, can drive all the grip rollers 16, 30, and 44 using the single electromagnetic clutch B, D, or F, thereby reducing noise. In addition, provision of blocking members and a rigid housing for reducing noise is not needed, thereby reducing production costs.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. Multiple sheet feeders stackable in multiple levels and attachable to an image forming apparatus, each sheet feeder comprising:

a drive source;

a drive transmission unit;

a first drive coupling unit connected to the drive source via the drive transmission unit;

a second drive coupling unit connected to the drive source via the drive transmission unit and the first drive coupling unit;

a sheet feed roller coaxial with the second drive coupling unit to feed a recording medium from the sheet feeder, the sheet feed roller being driven by a drive force of the drive source transmitted to the second drive coupling unit via the drive transmission unit and the first drive coupling unit; and a grip roller provided downstream from the sheet feed roller in a sheet feeding direction, the grip roller being driven by a drive force of the drive source transmitted to the first drive coupling unit via the drive transmission unit, during operation of multiple sheet feeders stacked in the multiple levels, the drive transmission unit coupled to the first drive coupling unit and provided to a given sheet feeder of the multiple sheet feeders, the first drive coupling unit of the given sheet feeder coupled to the grip roller of an adjacent sheet feeder disposed immediately below the given sheet feeder to drive the grip roller of each of the multiple sheet feeders substantially in synchrony, wherein the first drive coupling unit of a topmost sheet feeder is disposed immediately below an auxiliary roller provided in the image forming apparatus to drive the auxiliary roller substantially in synchrony with the grip roller of the topmost sheet feeder disposed immediately below the auxiliary roller.

2. The sheet feeder according to claim 1, wherein the drive transmission unit is constructed of a gear train.

3. The sheet feeder according to claim 1, wherein one of the first and second drive coupling units includes an electromagnetic clutch.

4. The sheet feeder according to claim 3, wherein an output side of the electromagnetic clutch is coupled to the grip roller.

5. The sheet feeder according to claim 3, wherein an output side of the electromagnetic clutch is coupled to the sheet feed roller.

6. The sheet feeder according to claim 1, wherein speed of the drive source is controllable.

7. The sheet feeder according to claim 6, wherein the drive source is rotatable both normally and reversely.

8. The sheet feeder according to claim 1, further comprising a gear to couple the first drive coupling units respectively provided to each one of the multiple sheet feeders to one another during the operation of the multiple sheet feeders.

9. An image forming apparatus comprising:

an image forming unit to form an image on a recording medium; and multiple sheet feeders stackable in multiple levels and attachable to the image forming apparatus to feed the recording medium to the image forming unit, each sheet feeder including:

a drive source;

a drive transmission unit;

a first drive coupling unit connected to the drive source via the drive transmission unit;

a second drive coupling unit connected to the drive source via the drive transmission unit and the first drive coupling unit;

a sheet feed roller coaxial with the second drive coupling unit to feed the recording medium from the sheet feeder, the sheet feed roller being driven by a drive force of the drive source transmitted to the second drive coupling unit via the drive transmission unit and the first drive coupling unit; and a grip roller provided downstream from the sheet feed roller in a sheet feeding direction, the grip roller being driven by a drive force of the drive source transmitted to the first drive coupling unit via the drive transmission unit, during operation of multiple sheet feeders stacked in the multiple levels, the drive transmission unit coupled to the first drive coupling unit and provided to a given sheet feeder of the multiple sheet feeders, and the first drive coupling unit of the given sheet feeder coupled to the grip roller of an adjacent sheet feeder disposed immediately below the given sheet feeder to drive the grip roller of each of the multiple sheet feeders substantially in synchrony; and an auxiliary roller provided in the image forming apparatus, wherein the first drive coupling unit of a topmost sheet feeder disposed immediately below the auxiliary roller is coupled to the auxiliary roller to drive the auxiliary roller substantially in synchrony with the grip roller of the topmost sheet feeder disposed immediately below the auxiliary roller.

* * * * *